US005979095A

United States Patent [19]

Schneider et al.

[11] Patent Number: 5,979,095

[45] Date of Patent: Nov. 9, 1999

[54] IDENTIFICATION BRACELET AND CLASP CONSTRUCTION THEREFOR

[75] Inventors: Barry L. Schneider, McHenry; Julie A. Duncan, Palatine, both of Ill.

[73] Assignee: Hollister Incorporated, Libertyville, Ill.

[21] Appl. No.: 08/874,028

[22] Filed: Jun. 12, 1997

[51] Int. Cl.[6] ..... A44C 5/00

[52] U.S. Cl. ..... 40/633; 40/666; 292/314; 24/704.1

[58] Field of Search ..... 40/633, 663, 664, 40/665, 666, 668; 292/307 R, 307 A, 314, 321; 24/543, 704.1

[56] References Cited

U.S. PATENT DOCUMENTS

| | | | |
|---|---|---|---|
| 3,059,359 | 10/1962 | Goldammer et al. . | |
| 3,708,835 | 1/1973 | Bienz . | |
| 3,755,859 | 9/1973 | Solari | 24/543 X |
| 3,800,450 | 4/1974 | Laugherty et al. . | |
| 3,823,443 | 7/1974 | Takabayashi . | |
| 3,824,654 | 7/1974 | Takabayashi | 24/543 X |
| 3,889,411 | 6/1975 | Laugherty et al. . | |
| 3,983,604 | 10/1976 | Phillips . | |
| 4,008,512 | 2/1977 | Prodel . | |
| 4,038,726 | 8/1977 | Takabayashi . | |
| 4,183,567 | 1/1980 | Bone . | |
| 4,198,772 | 4/1980 | Furutu . | |
| 4,221,063 | 9/1980 | Charles et al. . | |
| 4,285,146 | 8/1981 | Charles et al. . | |
| 4,318,234 | 3/1982 | Charles et al. . | |
| 4,514,882 | 5/1985 | Lavielle . | |
| 4,783,917 | 11/1988 | Smith et al. . | |
| 4,897,900 | 2/1990 | Baggett . | |
| 5,116,091 | 5/1992 | Swift | 292/321 X |
| 5,448,846 | 9/1995 | Peterson et al. . | |
| 5,577,395 | 11/1996 | Kuykendall . | |
| 5,615,504 | 4/1997 | Peter et al. | 40/665 X |

FOREIGN PATENT DOCUMENTS

| | | |
|---|---|---|
| 91/18955 | 12/1991 | WIPO . |

*Primary Examiner*—Brian K. Green
*Attorney, Agent, or Firm*—Tilton Fallon Lungmus

[57] ABSTRACT

A patient identification bracelet is composed of a flexible strap and a clasp, the clasp being formed of thermoplastic material and having a base member fixed to one end portion of the strap and a hinged cover member projecting laterally from the strap when the clasp is open. Holding elements project from at least one of the opposable surfaces of the cover and base member for engaging and holding the opposite end portion of the strap when the clasp is closed, and a mating post and socket are provided for locking the clasp in its closed condition. The post and socket are constructed so that the clasp, if forced open, cannot be reclosed. A relatively weak portion of the strap, located between the end portion of the strap that is fixed to the clasp and the identification-receiving portion of the strap, and also located between the base and cover members when the clasp is closed, defines a break-away zone for the strap when pulling forces of predetermined magnitude are applied thereto.

15 Claims, 5 Drawing Sheets

140
113
141
132
116
21
22
111
111a 120
22
119
118
140
112
116a
116
21
117a
117
114
113
141
22
116

112
21
140
132
117
111
114

240
132
241
21
111
111a 120
119
241
22
118
240
216
217
21

113
132
22
241
216
240
217
111
21
114

IDENTIFICATION BRACELET AND CLASP CONSTRUCTION THEREFOR

SUMMARY OF THE INVENTION

Patient identification bracelets of a variety of constructions and designs are known and in widespread use. Nevertheless, a need continues for a disposable identification bracelet that is of relatively low cost construction and which at the same time is easily operated, durable and reliable in use, and provided with a closure system that is secure and tamperproof. The term "tamper-proof" is here used to mean if the closure should be forced open after the bracelet has been attached to a patient's limb, it cannot be reclosed and the bracelet cannot be reused. Also, the circumference of the bracelet when secured cannot be adjusted (i.e., enlarged), thus rendering the bracelet non-transferable.

The non-reclosable identification bracelet of this invention takes the form of an elongated strap of tough, flexible and substantially non-stretchable sheet material having a clasp for securing the ends of the strap together after it has been placed about a patient's wrist (or ankle). The clasp is formed of thermoplastic material and has base and cover members joined by an integral hinge portion. The base member is fixed to one end portion of the strap so that the cover member projects laterally from one side edge of the strap when the clasp is open and is foldable into a closed position over the base member for clamping the opposite end of the strap after the strap has been wrapped about a wearer's limb. Holding or gripping means are provided along at least one (preferably both) of the opposable surfaces of the base and cover members for securely engaging the opposite end portion of the strap when the clasp is closed. Locking means are also provided by the clasp for securing the two members in closed condition.

The locking means takes the form of a post provided by one of the members and a socket provided by the other member. The post has head and stem portions, with the stem portion including a plurality of radially-extending and circumferentially-spaced ribs that connect the head to the member from which the post projects. A plurality of outwardly-facing recesses are located between the ribs, and such recesses receive a plurality of locking blades or fins formed in the wall of the socket when the post and socket are mated together. Since the ribs taken together are of a total cross section in their areas of connection to the (cover) member less than that of the combined cross sectional area of the locking blades or fins, a force of magnitude sufficient to pry the base and cover members apart after the clasp has been closed will have the effect of tearing or detaching the ribs, thereby destroying the post and rendering the clasp non-reclosable.

The holding or gripping means provided by the opposable surfaces of the clasp's base and cover members may take the form of a multiplicity of teeth projecting from one or both of the members. Preferably such teeth are provided along the opposable surfaces of both members and are generally pyramidal in shape, with the teeth of the respective members being offset from each other. The teeth of one of the members may have flat faces that are generally perpendicular to that member and face in one direction longitudinally of the strap, whereas the teeth of the other member may be provided with flat faces also perpendicular to such other member but facing in an opposite direction longitudinally of the strap.

In another embodiment, the holding or gripping means may take the form of ridges projecting from at least one, and preferably both, of the base and cover members. Such ridges extend generally transversely with the ridges of the respective members being offset with respect to each other. The ridges may have beveled edges and may extend perpendicular to the length of the strap. In a preferred construction, the transverse ridges are chevron-shaped. The chevron-shaped ridges may all point in the same direction longitudinally with respect to the strap or, in another embodiment of the invention, may be arranged in opposing sets to provide a generally diamond-shaped pattern of ridges for each of the hinged members of the clasp.

The first end portion of the strap that is fixed to the clasp has a relatively weak portion defined by an opening in the strap that is located between the attachment between the strap and clasp and the identification-receiving portion of the strap. The opening is thus located between the base and cover members when the clasp is closed and preferably allows the teeth or ridges of the base member to contact the opposite end portion of the strap when the bracelet is fastened about a wearer's wrist or ankle of particular importance is the fact that the opening or cutout reduces the cross-sectional area of the strap and thereby defines a transverse zone of weakness for preferential tearing of the strap when a pulling force exceeding a predetermined maximum is applied to the strap.

Other features, objects, and advantages of the invention will become apparent from the specification and drawings.

DRAWINGS

DETAILED DESCRIPTION OF THE PREFERRED EMBODIMENTS

Figure 2:
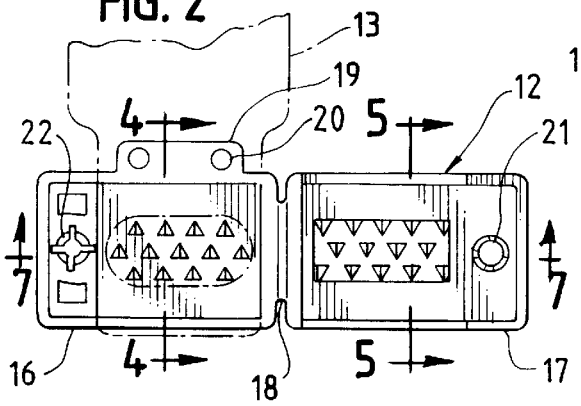
FIG. 2 is a top plan view of the clasp for the bracelet, such clasp being shown in open planar condition.
Figure 1:
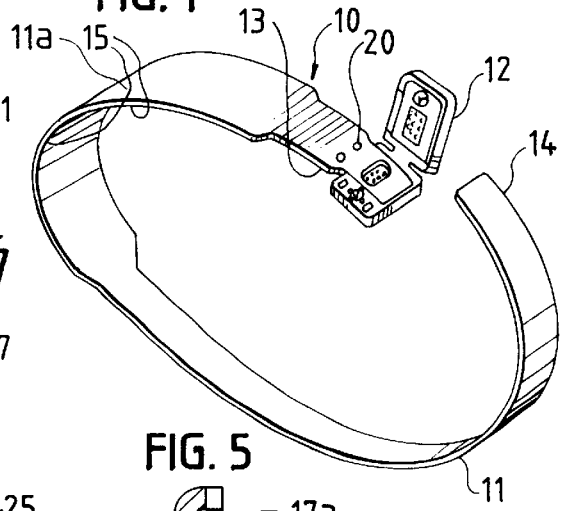
FIG. 1 is a perspective view of a patient identification bracelet embodying the invention.

Referring to FIGS. 1–10 of the drawings, the numeral 10 generally designates a patient identification bracelet comprising a strap or band 11 and a clasp 12. The elongate strap has first and second end portions 13 and 14, respectively, and generally parallel longitudinal side edges 15. Preferably, the strap has a relatively wide intermediate portion 11a for receiving printed, typed, or handwritten indicia setting forth vital information concerning the patient. The strap may be formed of any tough, flexible and substantially non-stretchable sheet material providing an outer surface capable of receiving indicia. A variety of such materials having these characteristics are well known in the art. One such material believed to be particularly effective is a trilaminate of synthetic paper (Kindura), polyester and textured polyethylene, but other materials having similar properties may be used.

The clasp 12 is formed in one piece from a tough and relatively stiff but flexible thermoplastic material such as nylon or a polyolefin (e.g., polypropylene). The clasp includes a base member 16 and a cover member 17 joined together by an integral hinge portion 18. As shown most clearly in FIGS. 1 and 6, the base member is staked or otherwise permanently secured to the first end portion 13 of the strap. For purposes of such attachment, the base portion includes a ledge or projection 19 that extends longitudinally with respect to strap 11 and is provided with integral stakes or pins 20 that project through openings in the strap to secure the strap and base member together. After being inserted into the openings of the strap, the stakes may be flattened (by heat and pressure) at their free ends to permanently anchor the parts together.

Figure 6:
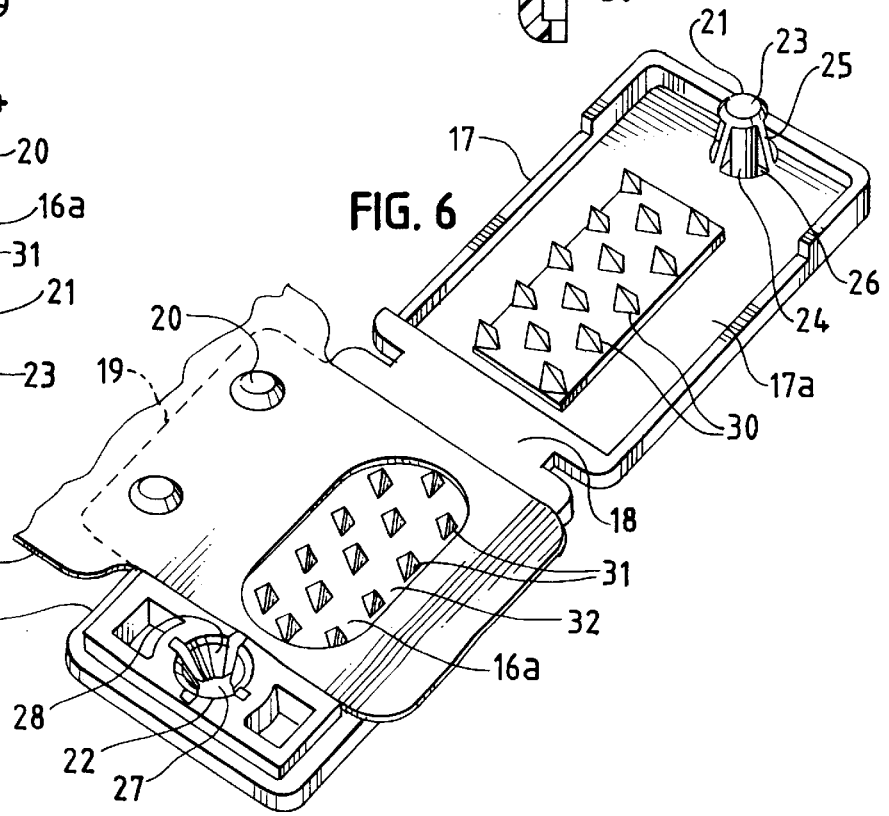
FIG. 6 is an enlarged perspective view showing the clasp and its attachment to one end of the strap.

The clasp 12 is secured to end portion 13 of the strap in a direction that extends transversely of the strap, with the hinge portion 18 parallel with the edges 15 of the strap and with the cover member 17 normally projecting laterally away from the strap, as shown in FIG. 6. (In FIG. 1, the cover member is shown in partially raised condition.) In use of the bracelet, the strap is wrapped loosely about a patient's wrist and free end portion 14 is drawn over the end portion 13 affixed to clasp 12. The cover member of the clasp is then closed to join the ends of the strap together.

Locking means for anchoring the cover member in closed condition takes the form of post 21 and socket 22. As shown most clearly in FIG. 6, the socket is provided by the base member along the opposite side of the strap 11 from hinge 18. While the base member is shown with only one such socket, and the cover member with only one post 21, it is to be understood that two such sockets and posts may be provided by the respective members, if desired. In any event, the socket(s) and post(s) are arranged to be brought into mating relation when the cover member is folded along hinge 18 into closed condition.

Figure 3:
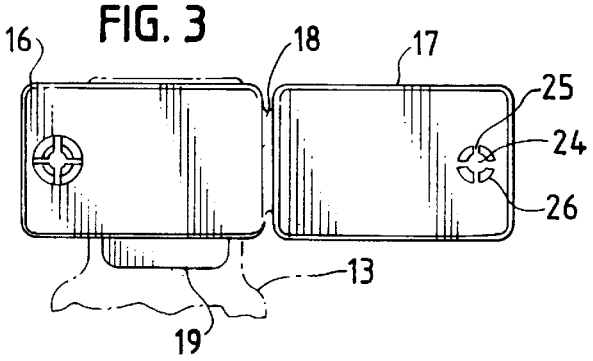
FIG. 3 is a plan view of the opposite side of the clasp of FIG. 2.

Post 21 includes a head portion 23 and a stem portion 24. A plurality of ribs 25 (four, in the embodiment illustrated) radiate outwardly from the stem and join the stem and head to the remainder of the cover member 17. As a result, the stem 24 and head 23 are not directly connected to the cover member. The ribs 25, which are integral with the post and cover member, serve as bridging connections, with arcuate spaces 26 between adjacent rib connections (FIGS. 6, 3). The strength of the connection between the post 21 and the cover member 17 therefore turns on the strength of the ribs and, specifically, the cross section of such ribs and their points of connection to the remainder of the cover member of which they are an integral part.

Figures 7, 8, 9, 10:
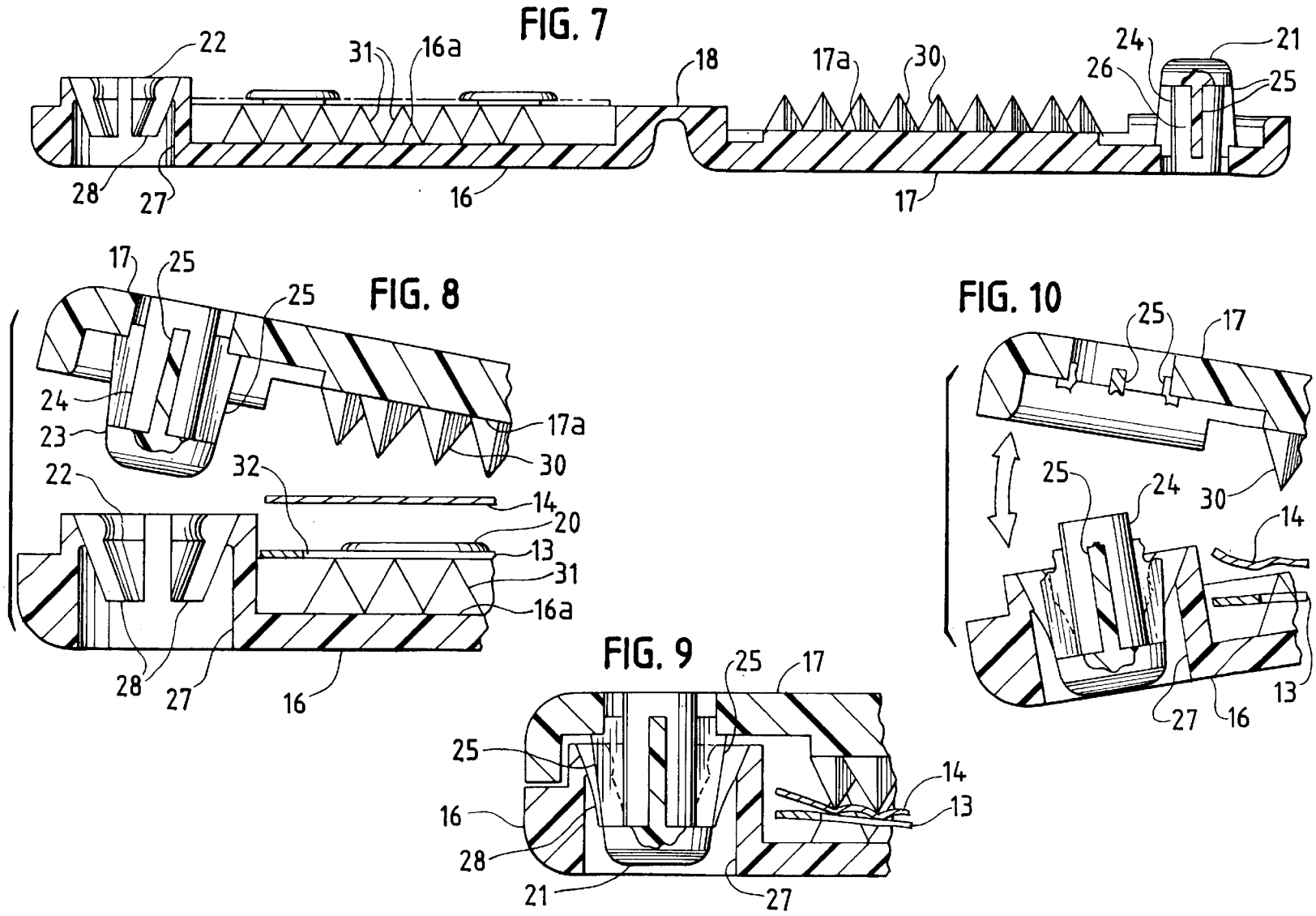
FIG. 7 is an enlarged sectional view taken along line 7—7 of FIG. 2.
FIG. 8 is a greatly enlarged fragmentary sectional view showing the clasp in partially closed condition.
FIG. 9 is a fragmentary sectional view similar to FIG. 8 but showing the clasp in fully closed condition.
FIG. 10 is a fragmentary sectional view similar to FIG. 9 but depicting the clasp after it has been pried open.

Socket 22 includes a generally cylindrical opening 27 in which is located a generally frusto conical arrangement of downwardly and inwardly sloping wall segments 28. The number of such segments corresponds to the number of recesses 26 provided by the post, and the segments 28 are positioned and arranged to be received within such recesses when the post and socket are fitted together. The segments 28 function as flexible blades or fins which bend outwardly to accommodate the head portion of the post as it is inserted into the socket and, once the head portion 22 has cleared them, the blades or fins 28 snap into recesses 26 to lock the base and cover members together (FIG. 9).

The cross sectional area of the integral connection between the blades or fins 28 and the remainder of base member 16 is substantially greater than the cross sectional area of the connection between ribs 25 and cover member 17. Therefore, once the cover has been closed as shown in FIG. 9, the post is securely retained in the socket and forces tending to pry the base and cover members apart only cause the blades or fins to seat more securely in the recesses 26 and bear more tightly against head 21. If the prying force is of sufficient magnitude to tear the clasp, such tearing occurs between the ribs 25 and their connection to cover member 17 (FIG. 10). Since detachment of the post from the cover member destroys the locking means and, more specifically, visually, tactilely, and mechanically eliminates one locking element of the pair, it is readily apparent when detachment of a bracelet has resulted from the application of such forces and equally apparent that reclosing of the band is impossible.

In the embodiment of FIGS. 1–10, holding or gripping means are provided by the clasp to prevent longitudinal sliding movement of the strap when the clasp is closed. Such gripping means takes the form of a multiplicity of teeth 30 and 31 projecting from the opposable surfaces 17*a* and 16*a* of the cover and base members 17 and 16, respectively. The teeth 30 of the cover member frictionally engage the upper surface of end portion 14 of the strap, whereas teeth 31 project upwardly through window opening 32 in the end portion 13 of the strap to engage the undersurface of end portion 14 when the strap has been fitted about a wearer's wrist and clasp 12 is closed.

Figure 5:
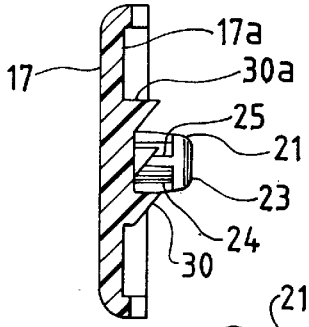
FIG. 5 is an enlarged sectional view taken along line 5—5 of FIG. 2.
Figure 4:
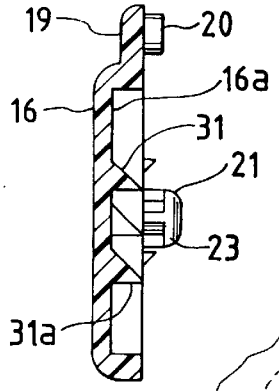
FIG. 4 is an enlarged sectional view taken along line 4—4 of FIG. 2.

It will be noted from FIGS. 4–6 that each tooth is generally pyramidal in shape with three faces, one of which 30*a*, 31*a* is normal or perpendicular to the plane of the surface from which the tooth projects. It will also be noted that perpendicular faces for the teeth of one set face in one longitudinal direction relative to the strap while the perpendicular faces of the teeth of the other set face in the opposite longitudinal direction. Hence, the two sets of teeth, taken together, engage opposite sides of strap end portion 14 and secure that end portion against sliding movement in either direction.

The teeth 30 and 31 of each set are offset from each other, causing an undulation in the engaged end portion of the strap 14 when the clasp is closed. Such deformation of the strap, combined with the frictional engagement or biting action of the teeth against the strap, effectively lock end portion 14 of the strap in place.

While two sets of teeth are shown in the drawings, sufficient locking action might be achieved with only one set of teeth, such as the multiplicity of teeth 30 provided by cover member 17. Two sets of teeth are shown in the preferred embodiment so that if a strong pulling force is applied in an effort to enlarge and remove a bracelet, the gripping force that prevents such sliding action will equal or exceed the tensile strength of the strap itself.

Figure 11:
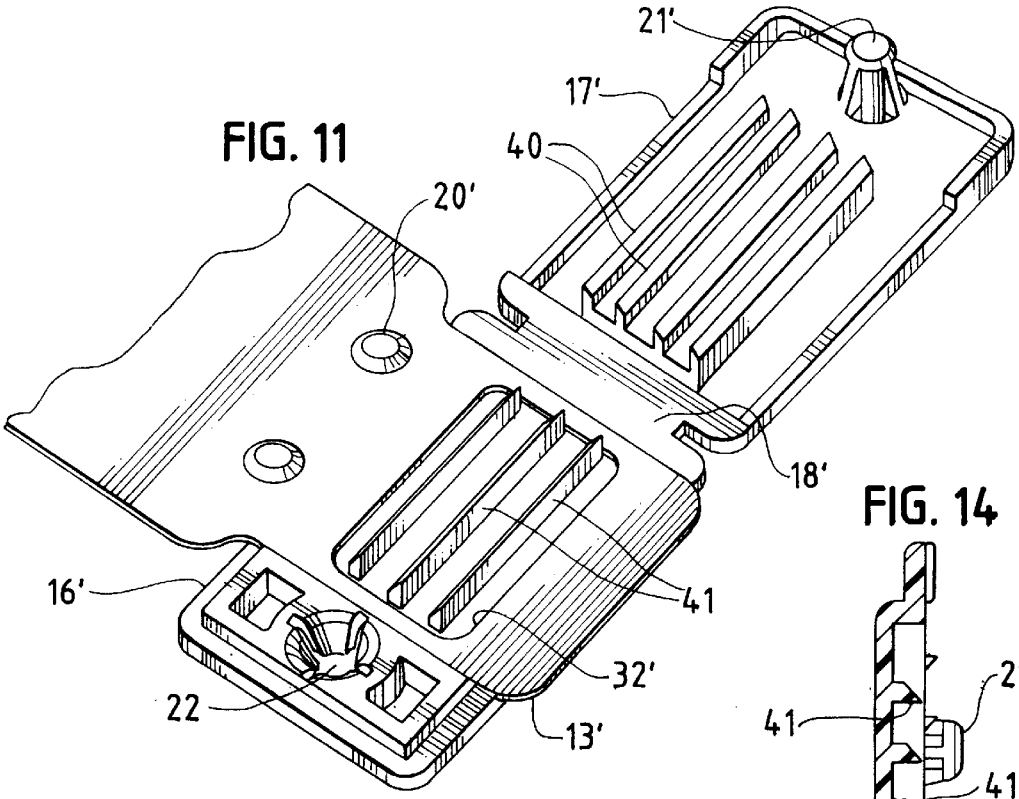
FIG. 11 is a perspective view similar to FIG. 6 but depicting a second embodiment of the invention having different gripping means.
Figure 12:
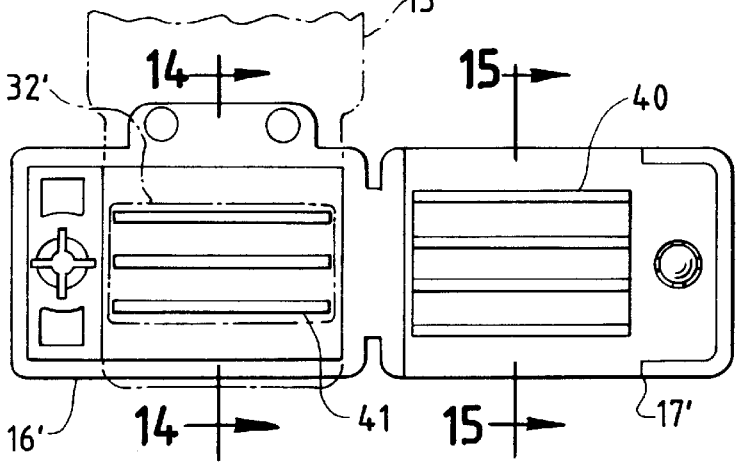
FIG. 12 is a plan view of the clasp of the second embodiment.
Figure 13:
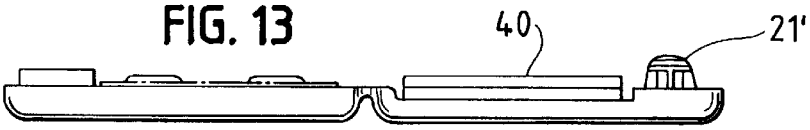
FIG. 13 is a side elevational view of the clasp.

The embodiment of FIGS. 11–13 is the same as the one already described except that the holding or gripping means takes the form of a plurality of spaced ridges 40 and 41 which project from the opposable surfaces 17*a*' and 16*a*' of cover member 17' and base member 16', respectively. The ridges extend transversely with respect to the strap 11' and, if desired, end portion 13' of the strap may be provided with a window 32' to expose ridges 41 for contact with the underside of the strap's other end portion when the bracelet is in place and cover member 17' is ready to be closed.

Figure 14:
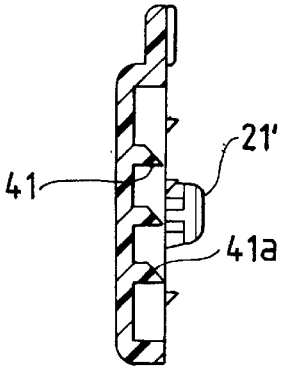
FIG. 14 is an enlarged sectional view taken along line 14—14 of FIG. 12.
Figure 15:
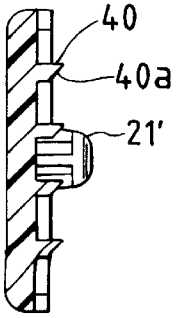
FIG. 15 is an enlarged sectional view taken along line 15—15 of FIG. 12.

It is to be noted from FIG. 12 that ridges 40 and 41 of the two sets are arranged in offset parallel relation. Thus, when the clasp is closed, the ridges 41 of the base member 16' extend between the parallel ridges 40 of cover member 17'. Also, referring to FIGS. 14 and 15, it will be seen that teeth 40 and 41 have beveled edges or end surfaces 40*a* and 41*a*, respectively. The beveled surfaces for one set of teeth 41 provided by base member 16' angle in one longitudinal direction relative to strap 11', whereas the beveled end surfaces 40*a* of teeth 40 of cover member 17' are angled in the opposite longitudinal direction.

As with the gripping means of the previously-described embodiment, ridges 40 and 41 restrain sliding movement of the clamped portion of a strap when the clasp is closed. Again, the provision of sets of offsetting ridges on both members 16' and 17' provides security against sliding movement of the strap and causes the portion of the strap between such ridges to assume a zigzag or undulating configuration, thereby reducing the possibility of sliding movement of the strap.

Figures 16, 17, 18:
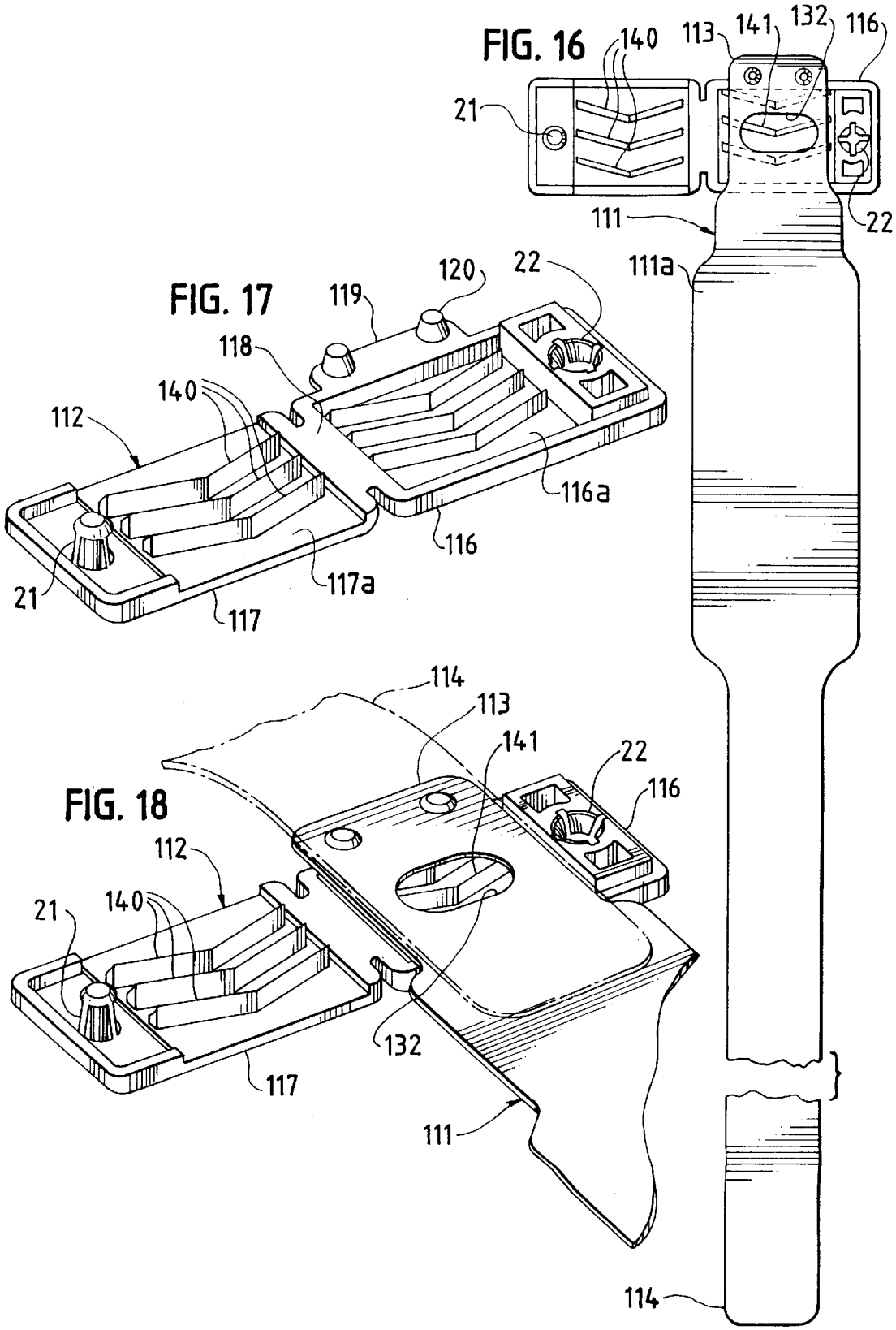
FIG. 16 is a plan view of an identification bracelet constituting a further embodiment of the invention.
FIG. 17 is a perspective view of the clasp prior to attachment to the strap.
FIG. 18 is a perspective view showing the clasp and strap in connected condition with the opposite end of the strap depicted in phantom as it might appear prior to closing of the clasp.

A third embodiment of the bracelet is depicted in FIGS. 16–18 and differs from the previous embodiments in features relating to the holding or gripping means of the clasp 112 and, in particular, the strap 111 and the way it is connected to the clasp. As in previous embodiments, the strap includes a first end portion 113, a second end portion 114, an intermediate portion (of greater width) for receiving patient information, and an opening or cutout 132 located in end portion 113 overlying the base member 116 of the clasp. In contrast to the previously-described embodiments, however, end portion 113 of the strap is fixed to a projection or ledge 119 located on the opposite or far side of the clip's base member 116 opening 132 is therefore disposed between the area of fixation of the strap's end portion 113 and the clip 112, on one hand, and the strap's intermediate indicia-receiving portion 111*a*, on the other. Because of the opening, the cross-sectional area of the strap, and hence the strength of the strap, are reduced in that area. The tear strength of the strap may therefore be adjusted to a predetermined level by varying the size of the opening for the particular strap material selected. When the bracelet is worn, the apertured portion of the strap disposed within the clasp constitutes a portion of predetermined weakness for preferential tearing of the strap when a pulling or tearing force of selected magnitude is reached. This allows the band to break or tear apart at a safe force level which not only prevents the possibility of the band from slipping within the clip but also reduces the chances of injury to a patient.

Since opening 132 overlies the gripping means provided by base member 117, it also allows direct contact between such gripping means and the second end portion 114 of the strap when the bracelet is fitted upon a patient. In this respect, opening 132 provides an advantage provided by previously-described embodiments.

The gripping means takes the form of a plurality of chevron-shaped ridges or ribs 140 and 141 which project from opposable surfaces 117*a* and 116*a* of the cover member 117 and base member 116, respectively. The chevron-shaped or V-shaped ridges all point in the same direction (preferably towards the distal second end 114 of the strap when the bracelet is in planar condition as shown in FIG. 16) and the spaced ridges of the respective members are offset so that one set of ridges 140 fits between the other set of ridges 141 when the clasp is closed. It will also be noted that the ridges are beveled with the beveled surfaces preferably facing away from end portion 114 of the strap when the bracelet is in the flat condition illustrated in FIG. 16.

In other respects, the bracelet of FIGS. 16–18 is similar to previous embodiments. In particular, the locking means for anchoring the cover member in closed condition takes the form of post 21 and socket 22 as previously shown and described.

Figures 19, 20, 21:
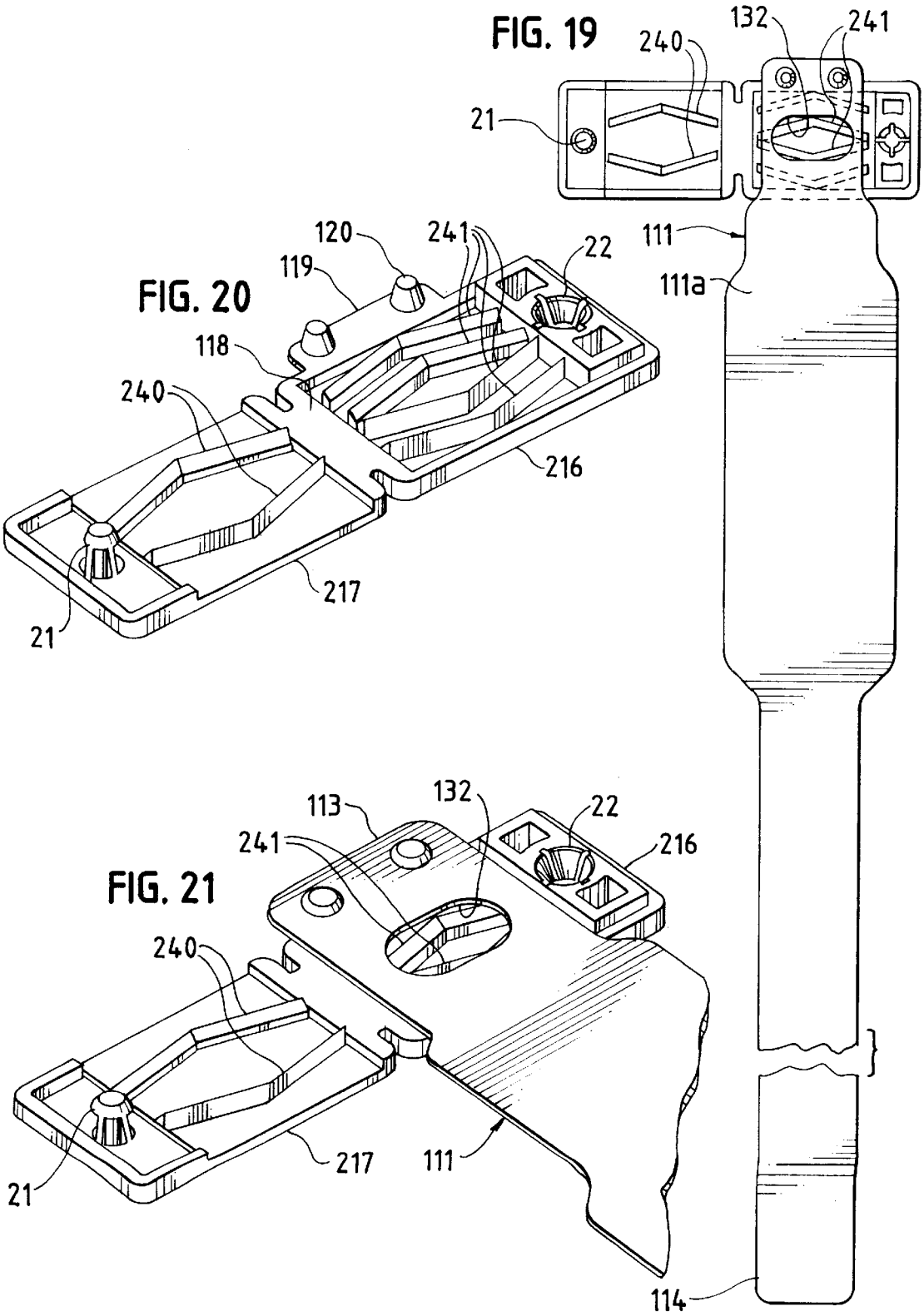
FIG. 19 is a plan view of a further embodiment of an identification bracelet embodying this invention.
FIG. 20 is a perspective view of a clasp prior to its attachment to a strap.
FIG. 21 is a perspective view of the clasp of FIG. 20 after its permanent attachment to one end of a strap.

The embodiment of FIGS. 19–21 is identical to that of FIGS. 16–18 except for the holding or gripping means provided by the base member 216 and cover member 217. Each member has its chevron-shaped ridges 240 and 241 arranged in opposition, forming a generally diamond-shaped pattern. Again, the ridges are beveled and those of one member are offset with respect to those of the other member so that there is an interfitting relationship between the two sets when the clasp is closed.

While in the foregoing, we have disclosed embodiments of the invention in considerable detail for purposes of illustration, it will be understood by those skilled in the art that many of these details may be varied without departing from the spirit and scope of the invention.

We claim:

1. An identification bracelet comprising an elongate strap of tough, flexible and substantially non-stretchable sheet material having first and second end portions and an identification-receiving portion located therebetween and adjacent to said first end portion; a clasp of thermoplastic material having base and cover members joined by an integral hinge portion; said base member being fixed to said strap at said first end portion with said cover member normally projecting laterally outwardly from said strap; said cover member being foldable into a closed position over said base member for clamping the strap's second end portion therebetween when said strap is to be secured about a wearer's limb; holding means projecting from at least one of said members for preventing sliding movement of said second end portion relative to said clasp when said clasp is closed; and locking means provided by said members for locking said clasp in closed condition; said locking means comprising a post provided by one of said members and a socket provided by the other of said members; said post having head and stem portions; said head portion being generally circular in outline and said stem portion including a plurality of radially-extending circumferentially spaced ribs constituting the sole means connecting said head portion to said one member and defining a plurality of outwardly-facing arcuate recesses therebetween; said socket including a plurality of circumferentially and uniformly spaced flexible blades receivable in said recesses and engagable with said head portion to block retraction of said post from said socket; the connection of said ribs to said one member being of lesser cross section than the connection of said blades to said other member so that upon the application of forces of substantial magnitude applied to force apart the members of the clasp, said ribs will separate from said one member before said blades separate from said other member.

2. The identification bracelet of claim 1 in which said post is an integral part of said cover member and said socket is an integral part of said base member.

3. The identification bracelet of claim 1 in which said blades of said socket extend in a frusto-conical arrangement with adjacent edges of said blades spaced apart to receive said ribs of said post.

4. The identification bracelet of claim 3 in which said blades extend in the same axial direction as said post when said clasp is closed.

5. A clasp for connecting opposite end portions of a strap of an identification bracelet; said clasp being formed of thermoplastic material and having base and cover members joined by an integral hinge portion; means provided by said base portion for securing said clasp to one end of a strap with said hinge portion generally parallel with the strap and said cover member projecting laterally therefrom; said cover member being foldable into a closed position over said base member for clamping an opposite end portion of said strap therebetween; and locking means provided by said members for locking said clasp in closed position; said locking means comprising a post provided by one of said members and a socket provided by the other of said members; said post having head and stem portions; said head being generally circular in outline and said stem portion including a plurality of radially-extending circumferentially-spaced ribs constituting the sole means connecting said head portion to said one member and defining a plurality of outwardly-facing arcuate recesses therebetween; said socket including a plurality of flexible blades receivable in said recesses and engagable with said head portion to block retraction of said post from said socket; the connection of said ribs to said one member being of lesser cross section than the connection of said blades to said other member so that upon the application of forces of substantial magnitude applied to force apart the members of said clasp, said members will separate from one another before said blades separate from said other member.

6. The clasp of claim 5 in which said post is an integral part of said cover member and said socket is an integral part of said base member.

7. The clasp of claim 5 in which said blades of said socket extend in a frusto-conical arrangement with adjacent edges of said blades spaced apart to receive said ribs of said post.

8. The clasp of claim 5 in which said blades extend in the same axial direction as said post when said clasp is closed.

9. A clasp for connecting opposite end portions of a strap of an identification bracelet; said clasp being formed of thermoplastic material and having base and cover members joined by an integral hinge portion; means provided by said base portion for securing said clasp to one end of a strap with said hinge portion generally parallel with the strap and said cover member projecting laterally therefrom; said cover member being foldable into a closed position over said base member for clamping an opposite end portion of said strap therebetween; and locking means provided by said members for locking said clasp in closed position; said locking means comprising a post provided by one of said members and a socket provided by the other of said members; said post having head and stem portions; said stem portion including a plurality of radially-extending circumferentially-spaced ribs connecting said head to said one member and defining a plurality of outwardly-facing recesses therebetween; said socket including a plurality of flexible blades receivable in said recesses and engagable with said head to block retraction of said post from said socket; the connection of said ribs to said one member being of lesser cross section than the connection of said blades to said other member so that upon the application of forces of substantial magnitude applied to force apart the members of said clasp, said members will separate from one another before said blades separate from said other member; said holding means comprising a plurality of ridges projecting from opposite surfaces of both of said members and formed integrally therewith; said ridges of the respective members being arranged in offset interfitting relation.

10. The clasp of claim 9 in which said ridges of the respective members have beveled edges.

11. The clasp of claim 10 in which said beveled edges of the ridges of one of said members face in one direction and those of the ridges of the other of said members face in an opposite direction.

12. The clasp of claim 10 in which each of said ridges is chevron-shaped.

13. The clasp of claim 12 in which all of said chevron-shaped ridges point in the same direction towards one end of said strap.

14. The clasp of claim 12 in which each of said members has two sets of said chevron-shaped ridges; said sets for each member pointing in opposite directions towards opposite ends of said strap.

15. The clasp of claim 9 in which each of said ridges is straight and extends tranversely with respect to said band.

* * * * *